US009551146B2

(12) United States Patent
Pham et al.

(10) Patent No.: US 9,551,146 B2
(45) **Date of Patent: *Jan. 24, 2017**

(54) METHOD FOR INSTALLING ACOUSTIC PANEL

(71) Applicant: ARMSTRONG WORLD INDUSTRIES, INC., Lancaster, PA (US)

(72) Inventors: Phi-Oanh R. Pham, Lancaster, PA (US); Jeffrey Scott Roberts, Columbia, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/944,281

(22) Filed: Nov. 18, 2015

(65) Prior Publication Data

US 2016/0265222 A1 Sep. 15, 2016

Related U.S. Application Data

(63) Continuation of application No. 14/643,536, filed on Mar. 10, 2015, now Pat. No. 9,238,912.

(51) Int. Cl.

| | |
|---|---|
| ***E04B 1/84*** | (2006.01) |
| ***E04B 9/00*** | (2006.01) |
| ***E04B 9/04*** | (2006.01) |
| ***E04B 9/24*** | (2006.01) |

(52) U.S. Cl.

CPC ..... *E04B 9/001* (2013.01); *E04B 1/8409* (2013.01); *E04B 9/04* (2013.01); *E04B 9/241* (2013.01)

(58) Field of Classification Search

CPC ..... E04B 1/82; E04B 1/86; E04B 2001/8263; E04B 9/001; E04B 9/28; E04B 9/003; E04B 9/241; E04B 9/24; E04B 9/0435; E04B 1/8409; E04B 1/04

See application file for complete search history.

(56) References Cited

U.S. PATENT DOCUMENTS

| | | | | |
|---|---|---|---|---|
| 3,183,996 | A | 5/1965 | Capaul | |
| 3,422,920 | A * | 1/1969 | Sabine | E04B 1/8409 156/253 |
| 4,201,247 | A | 5/1980 | Shannon | |
| 4,642,951 | A * | 2/1987 | Mortimer | B29C 51/00 181/290 |
| 5,202,174 | A | 4/1993 | Capaul | |
| 5,824,973 | A * | 10/1998 | Haines | B32B 5/22 181/286 |
| 6,305,495 | B1 * | 10/2001 | Keegan | D04H 13/007 181/287 |
| 6,443,256 | B1 | 9/2002 | Baig | |
| 7,703,254 | B2 * | 4/2010 | Alderman | E04B 9/001 428/68 |
| 7,798,287 | B1 | 9/2010 | Surace et al. | |

(Continued)

OTHER PUBLICATIONS

Product Information Sheet, "LYRA (tm) Square Lay-In, Tegular (smooth texture)," pp. 186A-D, Armstrong.com/commceilings. US , 2014.

*Primary Examiner* — Beth Stephan
(74) *Attorney, Agent, or Firm* — Craig M. Sterner

(57) ABSTRACT

Described herein is a multi-component panel comprising a ceiling panel and a sound attenuation layer, as well as a ceiling system that includes the multi-component panel.

20 Claims, 10 Drawing Sheets

(56) References Cited

U.S. PATENT DOCUMENTS

| | | | | |
|---|---|---|---|---|
| 8,734,613 | B1 | 5/2014 | Frank et al. | |
| 2004/0016184 | A1 * | 1/2004 | Huebsch | E04B 9/001 52/144 |

* cited by examiner

METHOD FOR INSTALLING ACOUSTIC PANEL

CROSS-REFERENCE TO RELATED APPLICATIONS

This application is a continuation of U.S. patent application Ser. No. 14/643,536 filed on Mar. 10, 2015. The disclosure of the above application is incorporated herein by reference.

FIELD OF INVENTION

Embodiments of the present invention relate to laminate acoustic ceiling panels, methods for preparing laminate acoustic ceiling panels, and ceiling systems comprising the laminate acoustic ceiling panels.

BACKGROUND

Various types of ceiling systems have been used in commercial and residential building construction to provide the desired acoustical performance. Noise blocking between rooms is required for a variety of purposes, including speech privacy as well as not bothering the occupants of adjacent rooms. Sound dampening within a single room is also required for a variety of purposes, including decreasing volume levels within a single space.

Previous attempts have been made to improve noise blocking between adjacent rooms. However, such previous attempts have either been directed to single layered structures or laminate-structures having layers that are bonded together across substantially the entire interface of layers. Such previous attempts fail to address how the interface between layers impacts both noise blocking and sound dampening characteristics of the acoustic ceiling panels. Thus, there is a need for a new laminate acoustic ceiling panel having an interface that can enhances the desired acoustical properties.

SUMMARY

According to some embodiments, the present invention is directed to a method of installing a ceiling system comprising: mounting a first ceiling panel to a support grid, the first ceiling panel formed of a sound absorbing material and having an upper major surface opposite a lower major surface, the upper major surface of the first ceiling panel facing a plenary space that is formed above the support grid, wherein the first ceiling panel has an NRC value of at least 0.9; and subsequently positioning a first sound attenuation layer in a free-floating relationship atop the upper major surface of the first ceiling panel, wherein the first sound attenuation layer has a CAC value of at least 37, thereby forming a first multi-component panel having a CAC value of at least 40 and an NRC value of at least 0.95.

According to other embodiments, the present invention is directed to a method of installing a ceiling system comprising: providing a first ceiling panel having an upper major surface opposite a lower major surface, wherein the first ceiling panel has an NRC value of at least 0.9; subsequently overlaying a first sound attenuation layer in a free-floating relationship on the upper major surface of the first ceiling panel, wherein the first sound attenuation layer has a CAC value of at least 37, thereby forming a multi-component panel having a CAC value of at least 40 and an NRC value of at least 0.95; and subsequently mounting the multi-component panel to a support grid within an internal space of a building such that the upper major surface of the first ceiling panel is facing a plenary space that is formed above the support grid.

According to other embodiments, the present invention is directed to a method of installing a ceiling system comprising: providing a sound attenuation sheet having a length greater than a length of a first ceiling panel; cutting a first sound attenuation layer from the sound attenuation sheet, wherein the first sound attenuation layer has a length that is substantially equal to the length of the first ceiling panel; subsequently positioning the first sound attenuation layer in a free-floating relationship atop an upper major surface of the first ceiling panel, wherein the first sound attenuation layer has a CAC value of at least 37, thereby forming a first multi-component panel having a CAC value of at least 40 and an NRC value of at least 0.95; and mounting the multi-component panel to a support grid that is located within an internal space of a building such that the upper major surface of the first ceiling panel faces a plenary space that is formed above the support grid.

BRIEF DESCRIPTION OF THE DRAWINGS

The features of the exemplary embodiments of the present invention will be described with reference to the following drawings, where like elements are labeled similarly, and in which.

DETAILED DESCRIPTION

Figure 1:
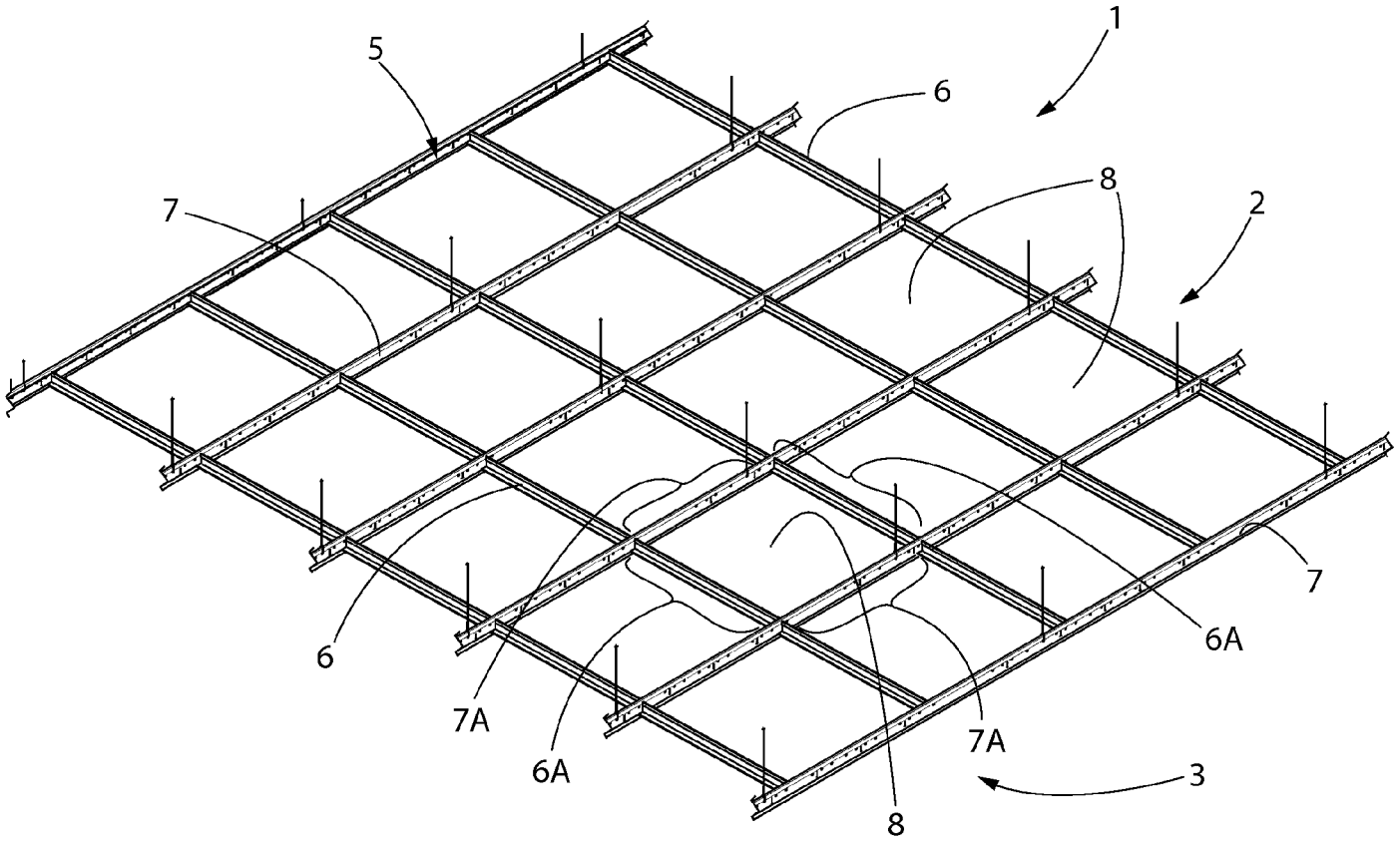
FIG. 1 is a perspective view of the support grid according to the present disclosure within an internal space.
Figure 2:
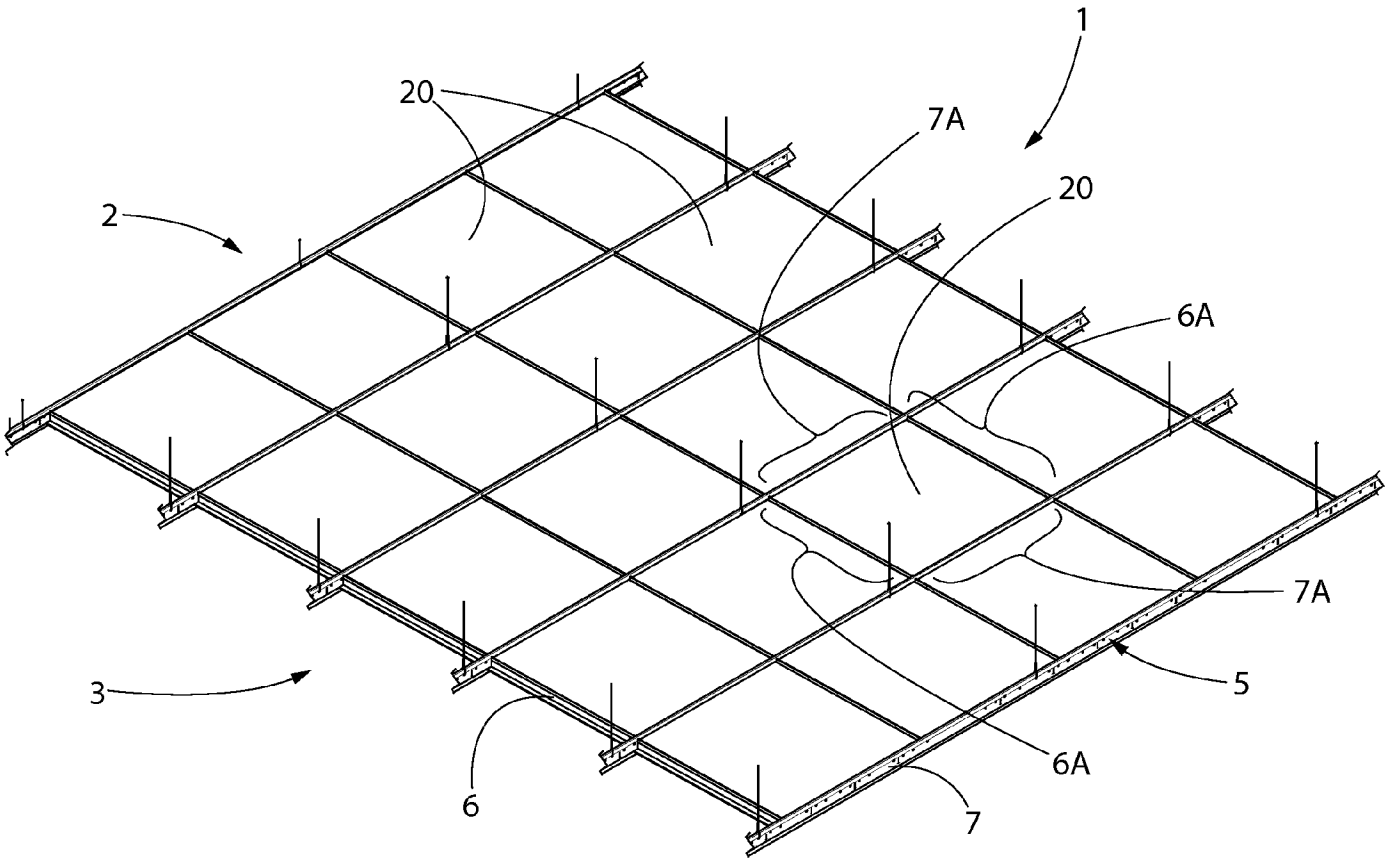
FIG. 2 is a perspective view of the ceiling system according to the present disclosure.

As shown in FIG. 2, the present invention is directed to a ceiling system 1 comprising a support grid 5 and at least one multi-component panel 20. A plenary space 2 may exist above the support grid 5. The plenary space 2 is the space that exists above the multi-component panels 20 and above the support grid 5 and below a roof or a subfloor 4 of an above adjacent floor in a building. The plenary space 2 provides room for mechanical lines to be run throughout a building—e.g. HVAC, plumbing, data lines, etc. A room environment 3 may exist below the multi-component panels 20 and below the support grid 5. The room environment 3 is the space occupied by inhabitants of a room—e.g. room environments 3 in an office building would be the space occupied by desks, office workers, computers, etc. The combination of the support grid 5 and the multi-component panels 20 may act as an acoustic, thermal, and aesthetic barrier between the room environment 3 and the plenary space 2, as well as a sound deadening layer for noise that exists within the room environment 3, as discussed herein.

The support grid 5 may comprise a plurality of first struts 6 extending parallel to each other. In some embodiments, the support grid 5 may further comprise a plurality of second struts 7 that extend parallel to each other. The plurality of first struts 6 may intersect the plurality of second struts 7 to form a grid pattern having a plurality of grid openings 8. In some embodiments, the plurality of first struts 6 intersects the plurality of second struts 7 at a substantially perpendicular angle, thereby forming rectangular grid openings 8. The rectangular grid openings 8 may be square or any other shape that is aesthetical or functional.

As shown in FIG. 6-10, each of the plurality of first struts 6 and each of the plurality of second struts 7 may comprises T-bars having a horizontal flange 10 and a web 11. The plenary space 2 exists above the T-bars and the room environment 3 exists below the T-bars.

The ceiling system 1 of the present disclosure comprises at least one multi-component panel 20 that is mounted within of the grid openings 8 of the support grid 5. The ceiling system 1 may comprises a plurality of multi-component panels 20 mounted to the support grid 5, each of the plurality of multi-component panels 20 resting within one of the plurality of grid openings 8. In some embodiments, something other than the multi-component panel 20 (for example, light fixture or an air duct vent) may be mounted to the support grid 5 within at least one of the grid openings 8 (not pictured).

Figure 3:
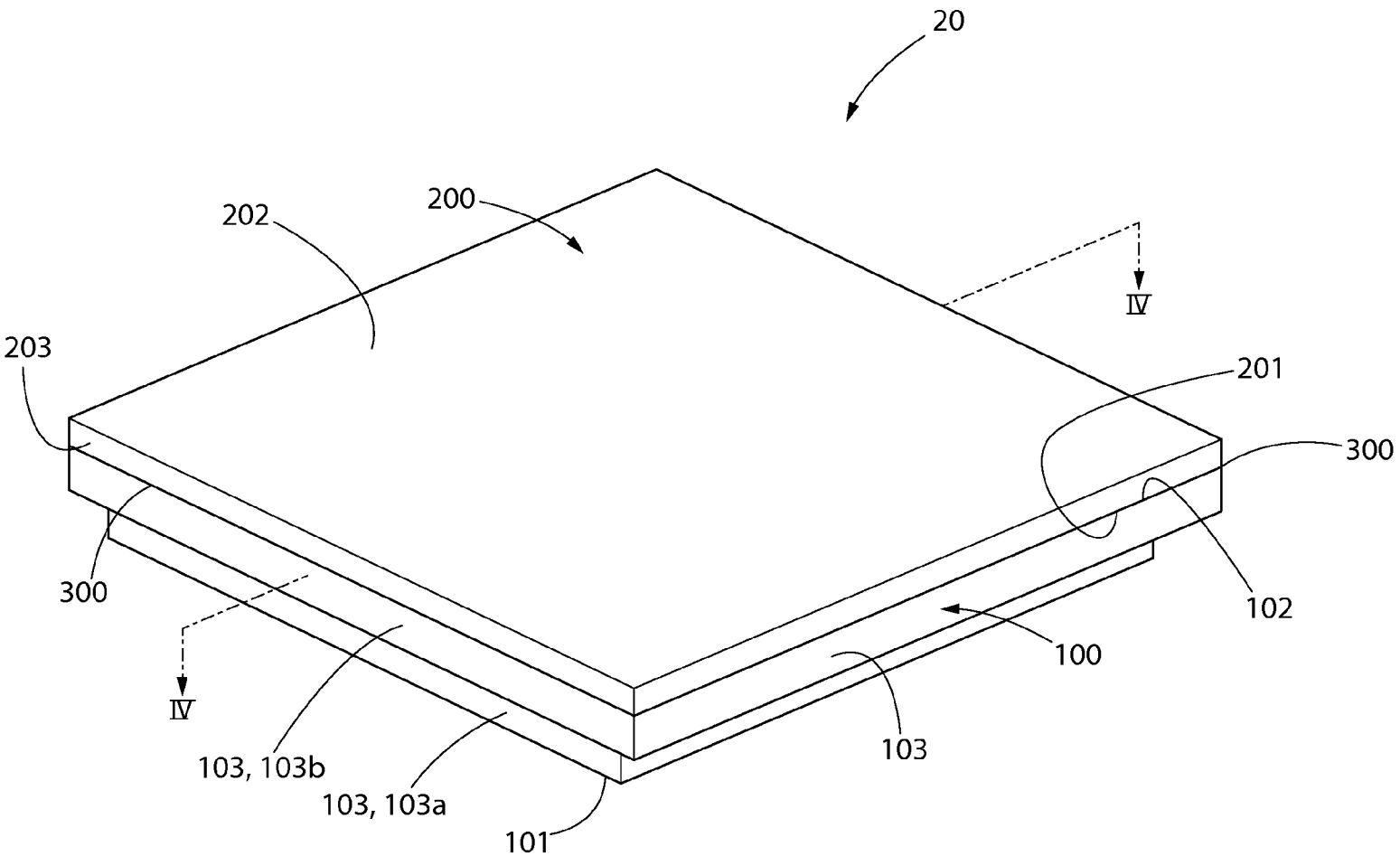
FIG. 3 is a perspective view of the multi-component panel according to the present disclosure.
Figure 5:
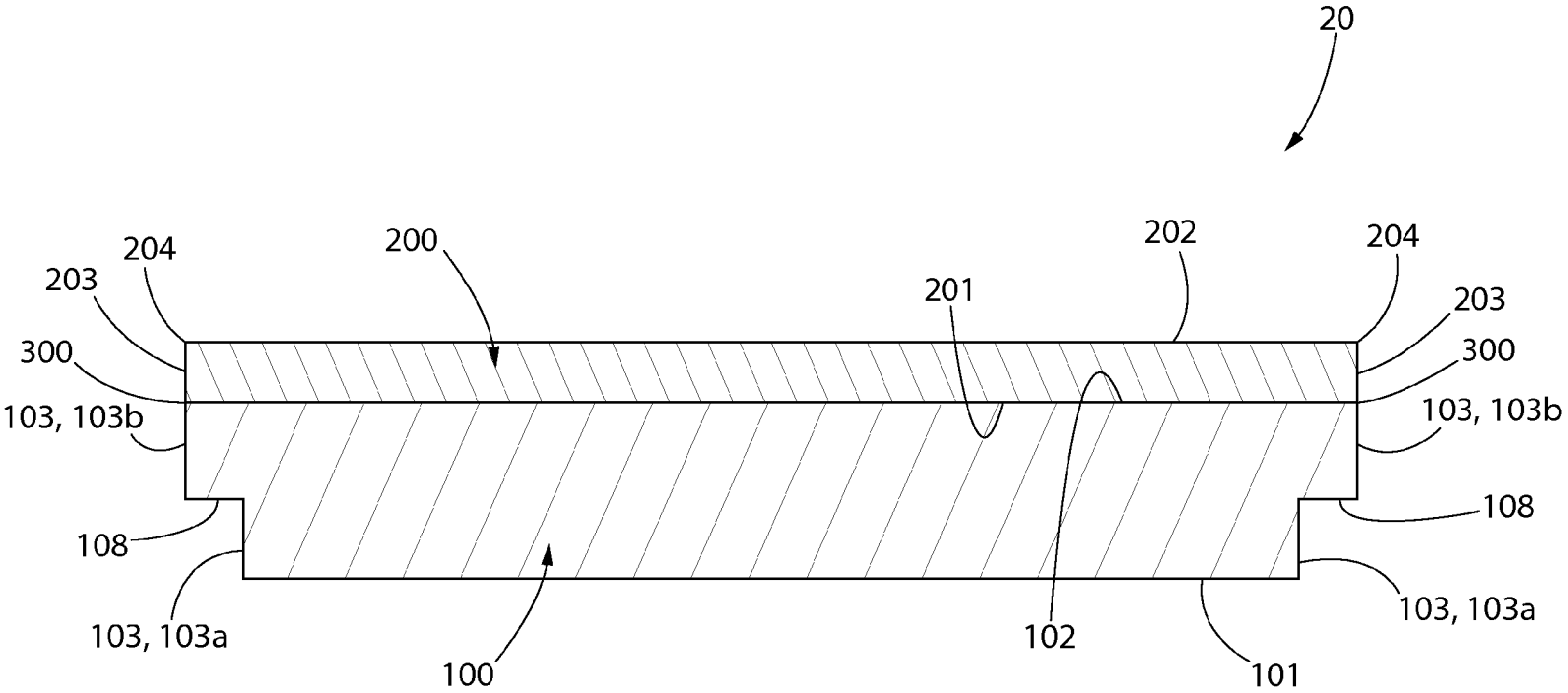
FIG. 5 is a cross-sectional view of the multi-component panel according to the present disclosure along line IV of FIG. 3.

As demonstrated by FIGS. 3 and 5, the multi-component panel 20 may comprise a ceiling panel 100 and a sound attenuation layer 200. In some embodiments of the present invention, the multi-component panel 20 may further comprise a scrim (not pictured). As demonstrated by FIGS. 8 and 11, the multi-component panel 20 may be mounted on the support grid 5 of the ceiling system 1 so that the ceiling panel 100 of the multi-component panel 20 is adjacent to the room environment 3 and the sound attenuation layer 200 is adjacent to the plenary space 2.

Figure 4:
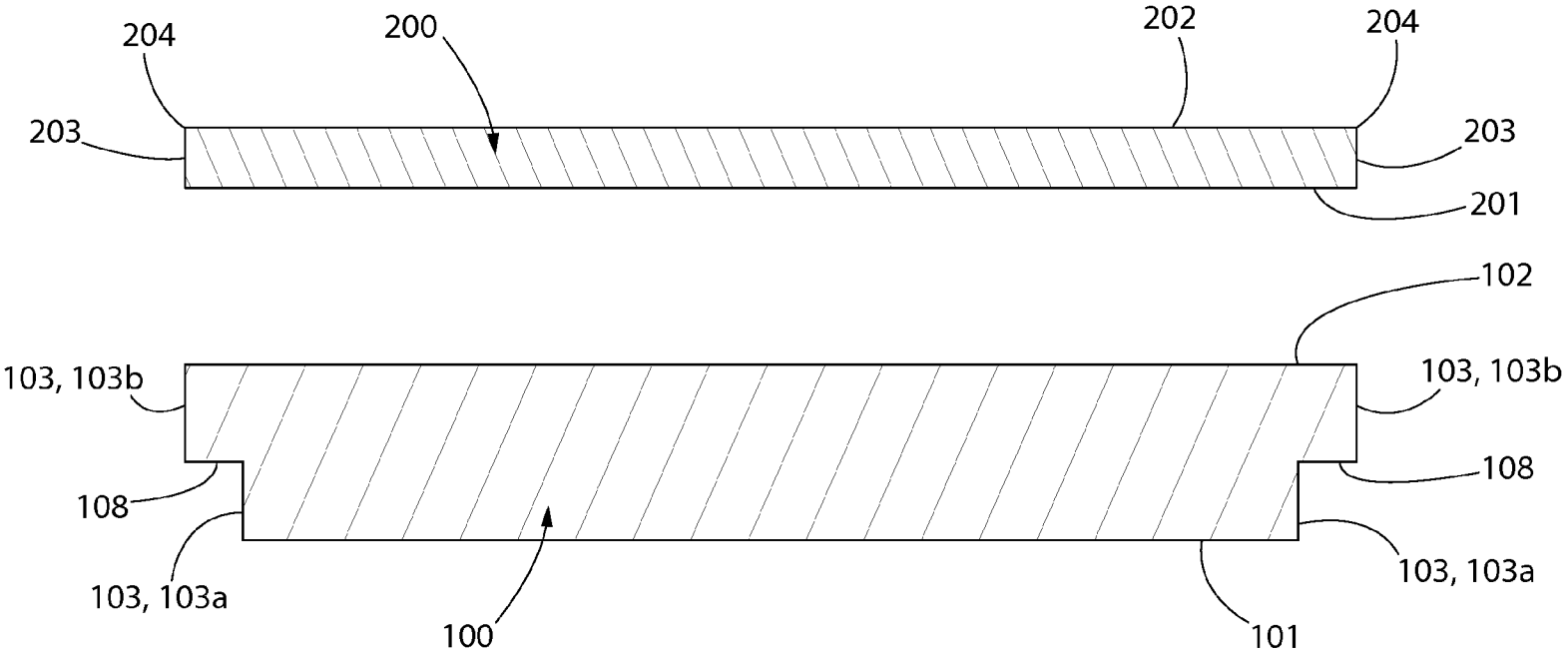
FIG. 4 is a cross-sectional view of the sound attenuation layer separated from and positioned above the ceiling panel according to the present disclosure along line IV of FIG. 3.

As shown by FIG. 4, the ceiling panel 100 comprises a lower major surface 101 and an upper major surface 102. The lower major surface 101 of the ceiling panel 100 may be opposite the upper major surface 102 of the ceiling panel 100. The first layer 100 further comprises a side surface 103 extending between the lower major surface 101 and the upper major surface 102.

The ceiling panel 100 may have an overall length and width. In some embodiments, the length of the ceiling panel 100 may be 12, 18, 24, 30, 48, 60, 72, or 96 inches. In some embodiments, the width of the ceiling panel 100 may be 4, 6, 12, 18, 20, 24, 30, or 48 inches.

The upper major surface 102 of the ceiling panel 100 may have a length and a width. The lower major surface 101 of the ceiling panel 100 may have a length and a width. In some embodiments each of the lengths and widths of the upper major surface 102 and lower major surface 101 of the ceiling panel 100 may share the overall length and widths of the ceiling panel. In some embodiments the length of the upper major surface 102 and the lower major surface 101 are equal. In some embodiments the width of the upper major surface 102 and the lower major surface 101 are equal. In some embodiments the length of the upper major surface 102 is greater than the length of the lower major surface 101. In some embodiments the width of the upper major surface 102 is greater than the width of the lower major surface 101.

In some embodiments of the present invention, the side surface 103 of the ceiling panel 100 may comprise a stepped profile having an upper side surface 103*b* and a lower side surface 103*a*. An intermediate surface 108 extends between the lower side surface 103*a* and the upper side surface 103*b* in a direction that is substantially perpendicular to the side surface 103, the upper side surface 103*a*, and the lower side surface 103*b* of the ceiling panel 100. In some embodiments, the intermediate surface 108 faces the same direction as the lower major surface 101 of the ceiling panel 100. In other embodiments, the intermediate surface 108 faces a direction oblique to the lower major surface 101.

The stepped profile comprises the combination of the upper side surface 103*b*, the intermediate surface 108, and the lower side surface 103*a*. According to this embodiment, the upper major surface 102 of the ceiling panel 100 has an area that is greater than an area of the lower major surface 101 of the ceiling panel 100. In some embodiments the surface area of the upper major surface 102 of the first layer 100 is equal to the sum of the area of the lower major surface 102 and the area of the intermediate surface 108 of the ceiling panel 100. According to this embodiment, at least one of the width and length of the lower major surface 101 of the ceiling panel 100 is less than the length and the width of the upper major surface 102 of the ceiling panel.

In some embodiments, the ceiling panel 100 comprising the stepped profile will have at least one of the length or width of the lower major surface 101 be less than the length or the width of the upper major surface 102 by a distance ranging from about 0.5 inches to about 2 inches.

In some embodiments, the stepped profile of the ceiling panel 100 may be present on each of the side surfaces 103 of the ceiling panel 100. In other embodiments, the stepped profile may only be present on two opposite side surfaces 103 of the ceiling panel 100. In a preferred embodiment, the ceiling panel 100 is closer to the sound source, e.g., facing the room environment 3.

In some embodiments, the ceiling panel 100 may be comprised of fiberglass, mineral wool (such as rock wool, slag wool, or a combination thereof), synthetic polymers (such as melamine foam, polyurethane foam, or a combination thereof), mineral cotton, silicate cotton, or combinations thereof. In some embodiments the ceiling panel 100 is produced from fiberglass. In some embodiments the ceiling panel 100 is formed of a sound absorbing material that predominantly provides a sound absorption function and preferred materials for providing the sound absorption function for the first layer 100 include fiberglass. The ceiling panel 100 provides a ceiling NRC rating of at least 0.9, preferably at least 0.95. NRC (Noise Reduction Coefficient) is further described below. The NRC value of the ceiling panel 100 is measured prior to the sound attenuation layer 200 being positioned atop the ceiling panel 100, as discussed herein. The ceiling panel 100 has a first rigidity. In some non-limiting embodiments of the present disclosure, the ceiling panel may be selected from the Optima™, and Lyra™ fiberglass panel lines produced by Armstrong (Armstrong World Industries, Inc.)—for example Lyra 8372 or Optima 3251.

As demonstrated by FIGS. 4 and 5, the sound attenuation layer 200 comprises a lower major surface 201 and an upper major surface 202. The lower major surface 201 of the sound attenuation layer 200 may be opposite the upper major surface 202 of the sound attenuation layer 200. The sound attenuation layer 200 may further comprise a side surface 203 extending between the lower major surface 201 of the sound attenuation layer 200 and the upper major surface 202 of the sound attenuation layer 200.

The upper major surface 202 of the sound attenuation layer 200 may have a length and a width. The lower major surface 201 of the sound attenuation layer 200 may have a length and a width. In some embodiments the length of the upper major surface 202 and the lower major surface 201 of the sound attenuation layer 200 are equal. In some embodiments the width of the upper major surface 202 and the lower major surface 201 of the sound attenuation layer 200 are equal. In some embodiments the length of the upper major surface 202 is smaller than the length of the lower major surface 201 of sound attenuation layer 200. In some embodiments the width of the upper major surface 202 is smaller than the width of the lower major surface 201.

In some embodiments the sound attenuation layer 200 may comprise fiberglass, mineral wool (such as rock wool, slag wool, or a combination thereof), synthetic polymers (such as melamine foam, polyurethane foam, or a combination thereof), mineral cotton, silicate cotton, gypsum, or combinations thereof. In some embodiments the sound attenuation layer 200 is produced from mineral wool. In some embodiments, the sound attenuation layer 200 predominantly provides a sound attenuation function and preferred materials for providing the sound attenuation function for the sound attenuation layer 200 include mineral wool.

The sound attenuation layer 200 provides a ceiling CAC rating of at least 37, preferably at least 40 and an NRC value of at least 0.65. CAC (Ceiling Attenuation Class) is further described below. The CAC and NRC values of the sound attenuation layer 200 are measured prior to being positioned atop the ceiling panel 100, as discussed herein. The sound attenuation layer 200 has a second rigidity. In some embodiments, the first rigidity of the ceiling panel 100 is greater than the second rigidity of the sound attenuation layer 100. In some embodiments, the first rigidity of the ceiling panel 100 and the second rigidity of the sound attenuation layer 100 are equal. In some non-limiting embodiments of the present disclosure, the ceiling panel may be selected from the School Zone™, and Cortega™ mineral wool panel lines produced by Armstrong—for example, School Zone 1810.

According to some embodiments and as shown in FIG. 3, the length of the upper major surface 102 of the first ceiling panel 100 is substantially equal to the length of the lower major surface 201 of the first sound attenuation layer 200. In some embodiments, the width of the upper major surface 102 of the first ceiling panel 100 is substantially equal to the width of the lower major surface 201 of the first sound attenuation layer 200.

According to some embodiments, the length of the upper major surface 102 of the first ceiling panel 100 is greater than the length of lower major surface 201 of the sound attenuation layer 200. According to some embodiments, the width of the upper major surface 102 of the first ceiling panel 100 is greater than the width of the lower major surface 201 sound attenuation layer 200. According to some embodiments, both the length and the width of the upper major surface 102 of the first ceiling panel 100 are greater than the width of the lower major surface 201 sound attenuation layer 200.

According to some embodiments, the length of the upper major surface 102 of the first ceiling panel 100 is less than the length of lower major surface 201 of the sound attenuation layer 200. According to some embodiments, the width of the upper major surface 102 of the first ceiling panel 100 is less than the width of the lower major surface 201 sound attenuation layer 200. According to some embodiments, both the length and the width of the upper major surface 102 of the first ceiling panel 100 are less than the width of the lower major surface 201 sound attenuation layer 200.

In some non-limiting embodiments, the ceiling system 1 of the present invention may be installed according to a first methodology. The first methodology may comprise a first step a) of mounting the support grid 5 within an internal space of a building so that the plenary space 2 is formed above the support grid 5 and the active room environment 2 is formed below the support grid 5. The support grid 5 comprises the plurality of intersecting first and second struts 6, 7 that form a plurality of grid openings 8. The grid openings 8 may be defined by sections 6A of opposing first ones of the intersecting struts (first struts 6) and sections 7A of opposing second ones of intersecting struts (second struts 7).

Figure 6:
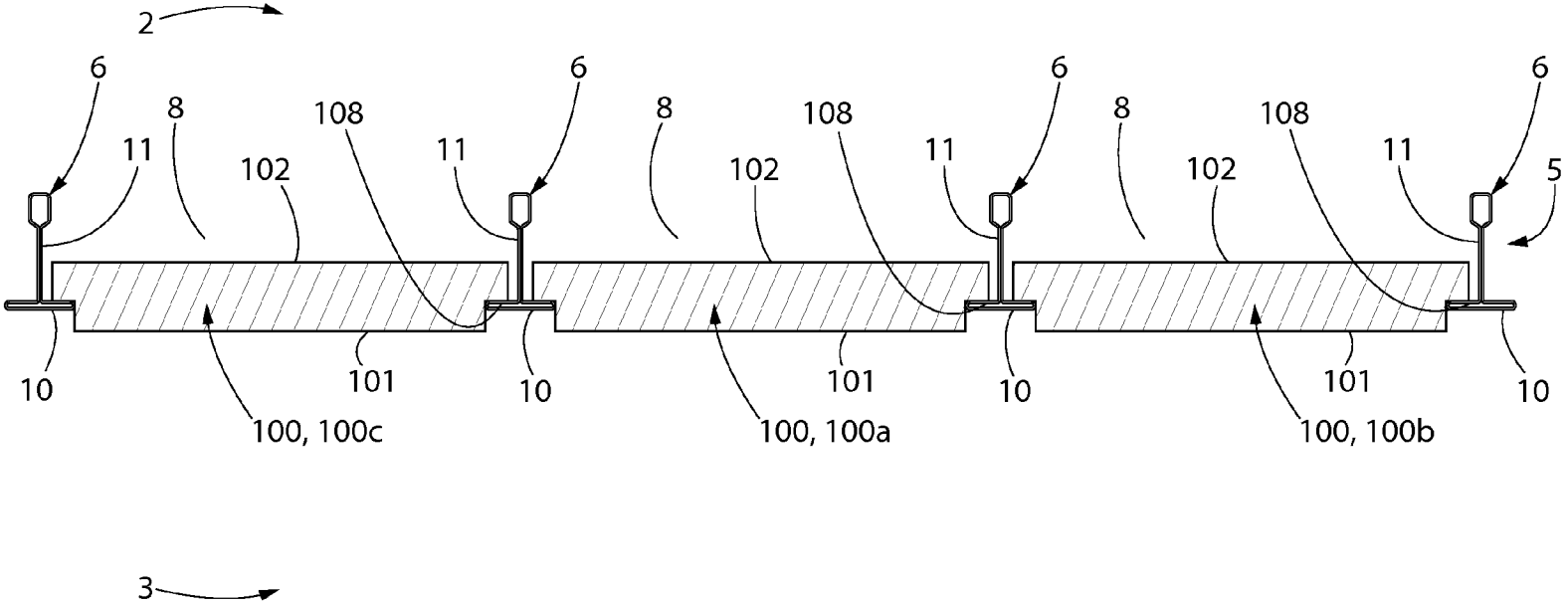
FIG. 6 is a side view of support grid having the plurality of openings with a ceiling panels resting in each opening according to the present disclosure.

Subsequent to step a), step b) comprises a first ceiling panel 100*a* being mounted to the support grid 5, as shown in FIG. 6. A second ceiling panel 100*b* and optionally a third ceiling panel 100*c* may also be mounted to the support grid 5 during step b). The first ceiling panel 100 is positioned within a first one of the openings 8 of the grid support 5 so that the upper major surface 102 of the first ceiling panel 100 is facing the plenary space 2—the same applies to the second and third ceiling panels 100. According to some embodiments, at least one of the ceiling panels 100 may positioned within the grid opening 8 so that the ceiling panel 100 is are circumscribed by the sections 6A, 7A of intersecting first and second struts 6, 7.

As shown in FIG. 6, when the ceiling panel 100 is mounted to the support grid 5, at least one of the lower major surface 101 or the intermediate surface 108 of the ceiling panel 100 may abut at least a portion of a top surface of the horizontal flange 10 of at least one of the first member 6 or the second member 7 of the support grid 5. The abutment between at least one of the lower major surface 101 or the intermediate surface 108 of the ceiling panel layer 100 and the top surface of the horizontal flange 10 allows the ceiling panel 10 to rest in a fully installed position within the ceiling system 1.

Figure 7:
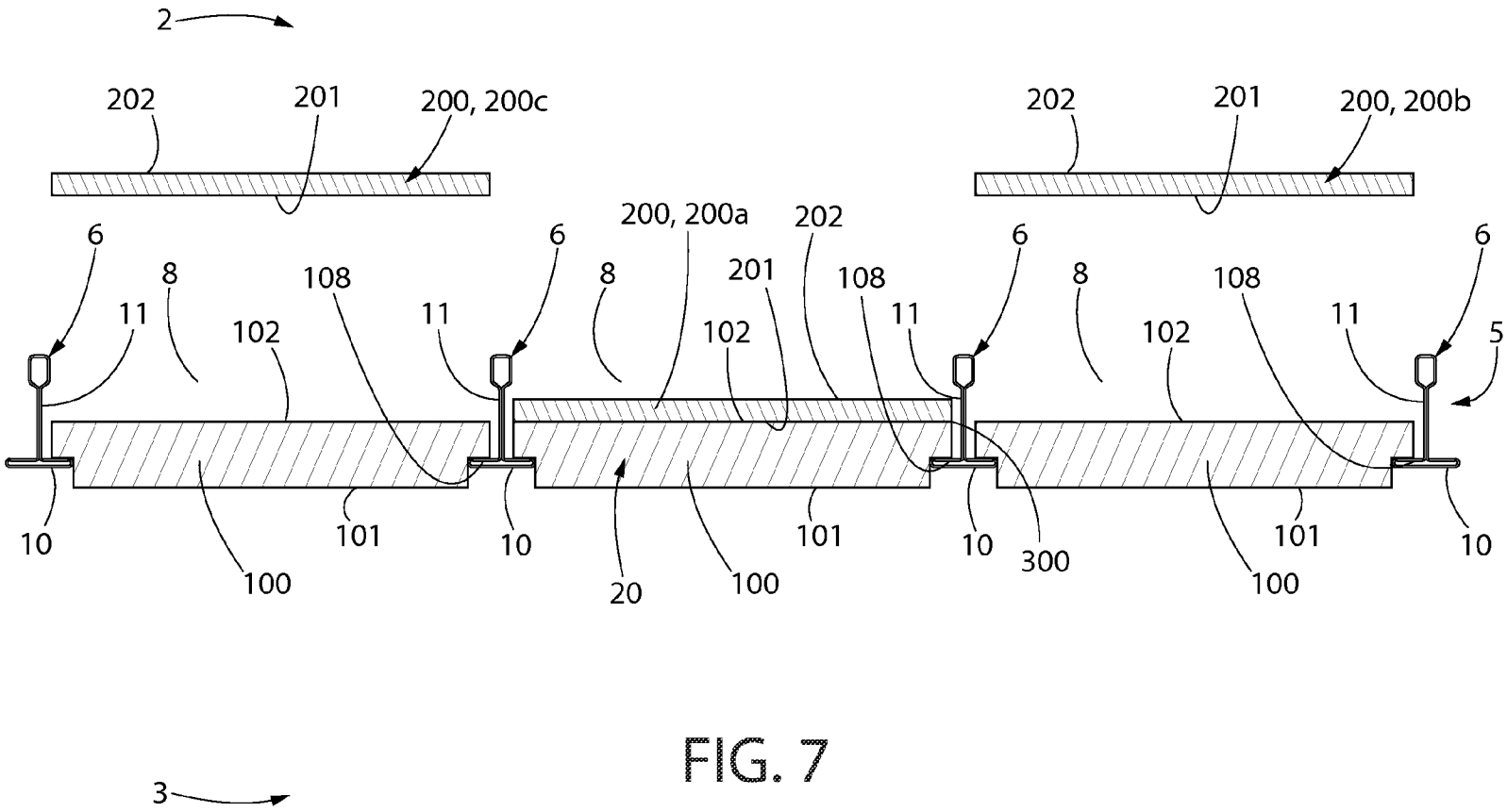
FIG. 7 is a side view of a partially installed ceiling system according to according to the present disclosure.
Figure 8:
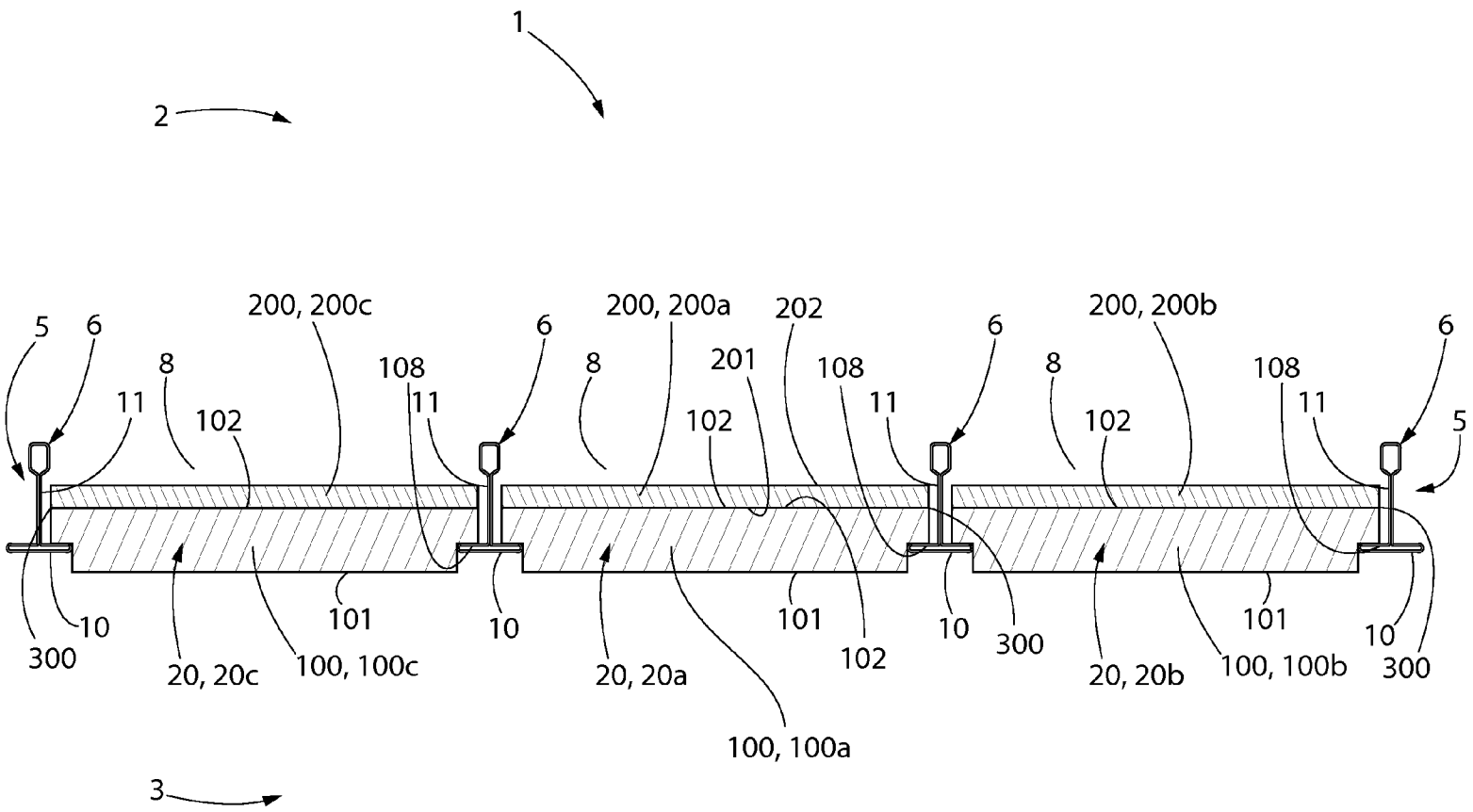
FIG. 8 is a side view of a ceiling system according to one embodiment of the present disclosure, including the support grid and a plurality of multi-component panels.

Subsequent to step b), step c) includes positioning a first sound attenuation layer 200*a* a free-floating relationship atop the upper major surface 102 of the first ceiling panel 100*a*, thereby forming a first multi-component panel 20*a*—as shown in FIG. 7. As shown in FIGS. 7 and 8, at least a second sound attenuation layer 200*b* may be positioned in a free-floating relationship atop the upper major surface 102 of the second ceiling panel 100*b* thereby forming a second multi-component panel 20*b* during step c). A third sound attenuation layer 200*c* may also be positioned in a free-floating relationship atop the upper major surface 102 of the third ceiling panel 100*c* thereby forming a third multi-component panel 20*c* during step c).

The multi-component panels 20, 20*a*, 20*b*, 20*c* have a CAC value greater than 37 and an NRC value of at least 0.95. According to some embodiments, at least one of the first, second, or third ceiling panels 100, 100*a*, 100*b*, 100*c* may positioned within the grid opening 8 so that the ceiling panel 100 and the sound attenuation layer 200 are circumscribed by the sections 6A, 7A of intersecting first and second struts 6, 7. The multi-component panels 20, 20*a*, 20*b*, 20*c* have a CAC value greater than 37 and an NRC value of at least 0.95.

In some embodiments of the present invention, the sound attenuation layer 200 may be cut to its final dimensions at the installation site. Specifically, prior to step b), the present invention may further include providing a sound attenuation sheet having a length greater than the length of the ceiling panel 100 (not pictured). At least one sound attenuation layer 200 may be cut from the sound attenuation sheet, wherein the at least one sound attenuation layer 200 has a length that is less than, substantially equal to, or greater than the length of the ceiling panel 100. Cutting sound attenuation layers 200 from the sound attenuation sheet prior to mounting of the ceiling panels allows for a variety of custom shaped sound attenuation layers 200 that correspond to a variety ceiling panel shapes 100 that may be used in a ceiling system 1. In some embodiments, the sound attenuation layer 200 may be cut from the sound attenuation sheet after step b) but prior to step c).

Figure 9:
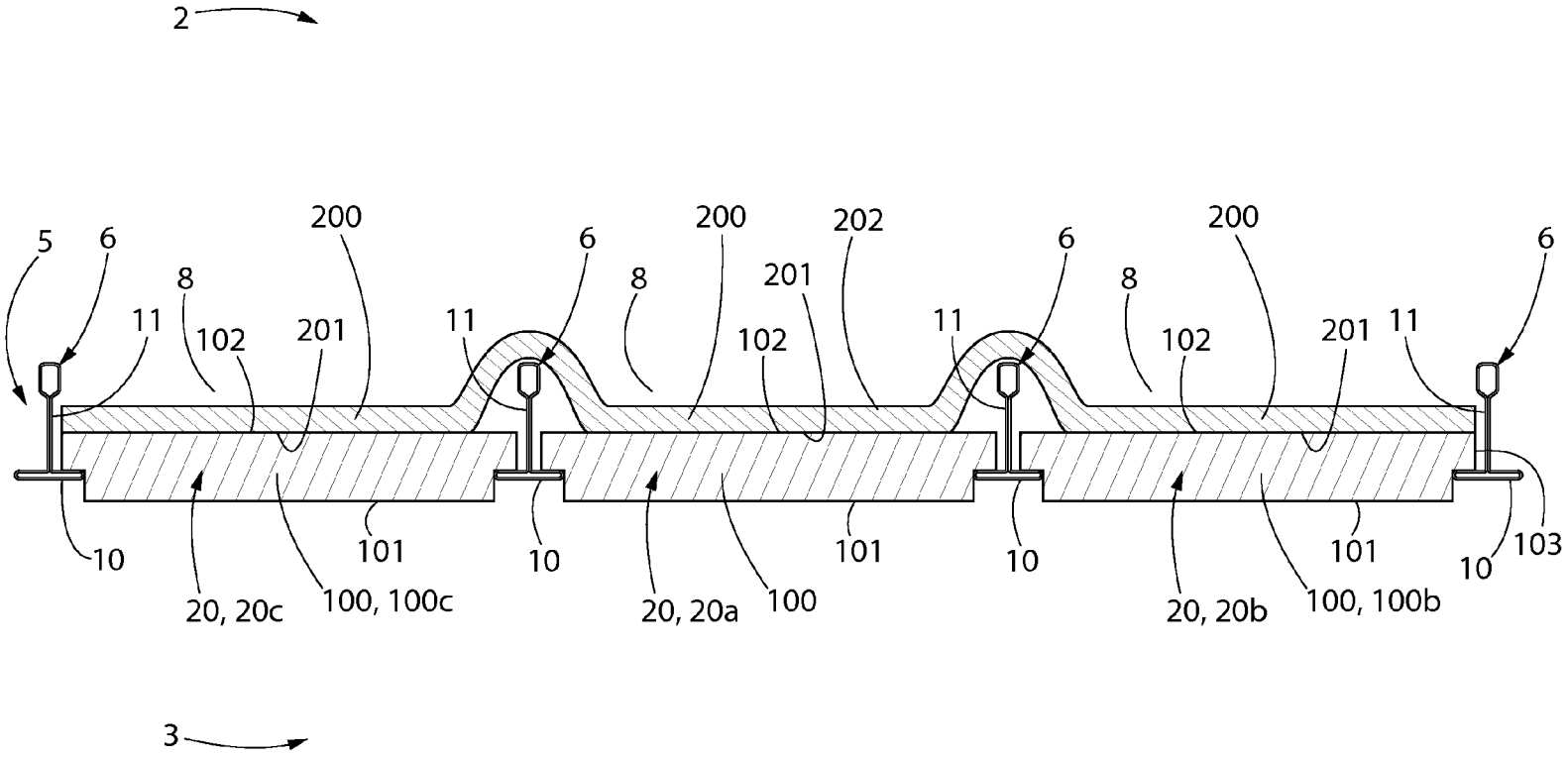
FIG. 9 is a side view of a ceiling system according to another embodiment of the present disclosure, including the support grid and a plurality of multi-component panels.

In an alternative embodiment shown in FIG. 9, step b) may include the first ceiling panel 100*a* and the second ceiling panel 100*b* being mounted to the support grid 5 in adjacent first and second openings 8. Following step b), an attenuation layer 200 is positioned in a free-floating relationship atop the upper major surface 102 of both the first and the second ceiling panels 100, 100*a*, 100*b*. The lower major surface 201 of the sound attenuation layer 200 may cover at least one of the sections 6A, 7A of the first or second strut 6, 7 that is positioned between the adjacent first and second ceiling panels 100, 200. The resulting first and second multi-component panels 20*a*, 20*b* have a sound attenuation layer 200 that provides a continuous structure across at least two openings 8, optionally three openings 8, in the support grid 5. The resulting sound attenuation layer may exhibit a CAC value greater than 37 and an NRC value of at least 0.95.

In other non-limiting embodiments, the ceiling system 1 of the present invention may be according to a second methodology. The second methodology may include a first step a) of mounting the support grid 5 within an internal space of a building so that the plenary space 2 is formed above the support grid 5 and the active room environment 2 is formed below the support grid 5. The support grid 5 comprises the plurality of intersecting first and second struts 6, 7 that form a plurality of grid openings 8. The grid openings 8 may be defined by sections 6A of opposing first ones of the intersecting struts (first struts 6) and sections 7A of opposing second ones of intersecting struts (second struts 7).

Subsequent to step a), step b) may include providing a first ceiling panel 100 and providing a first sound attenuation layer 100—as shown in FIG. 4. Subsequent to step b), step c) includes overlaying the first sound attenuation layer 200 in a free-floating relationship on the upper major surface 102 of the first ceiling panel 100, thereby forming an unmounted multi-component panel 20 having a CAC value greater than 37—as shown in FIG. 5.

Steps b) and c) may be repeated multiple times until reaching a number of multi-component panels 20 necessary to complete the installation of the ceiling system 1. Furthermore, it is possible that the sound attenuation layer 200 may be cut to its final dimensions at the installation site from a sound attenuation sheet—as previously discussed.

Figure 10:
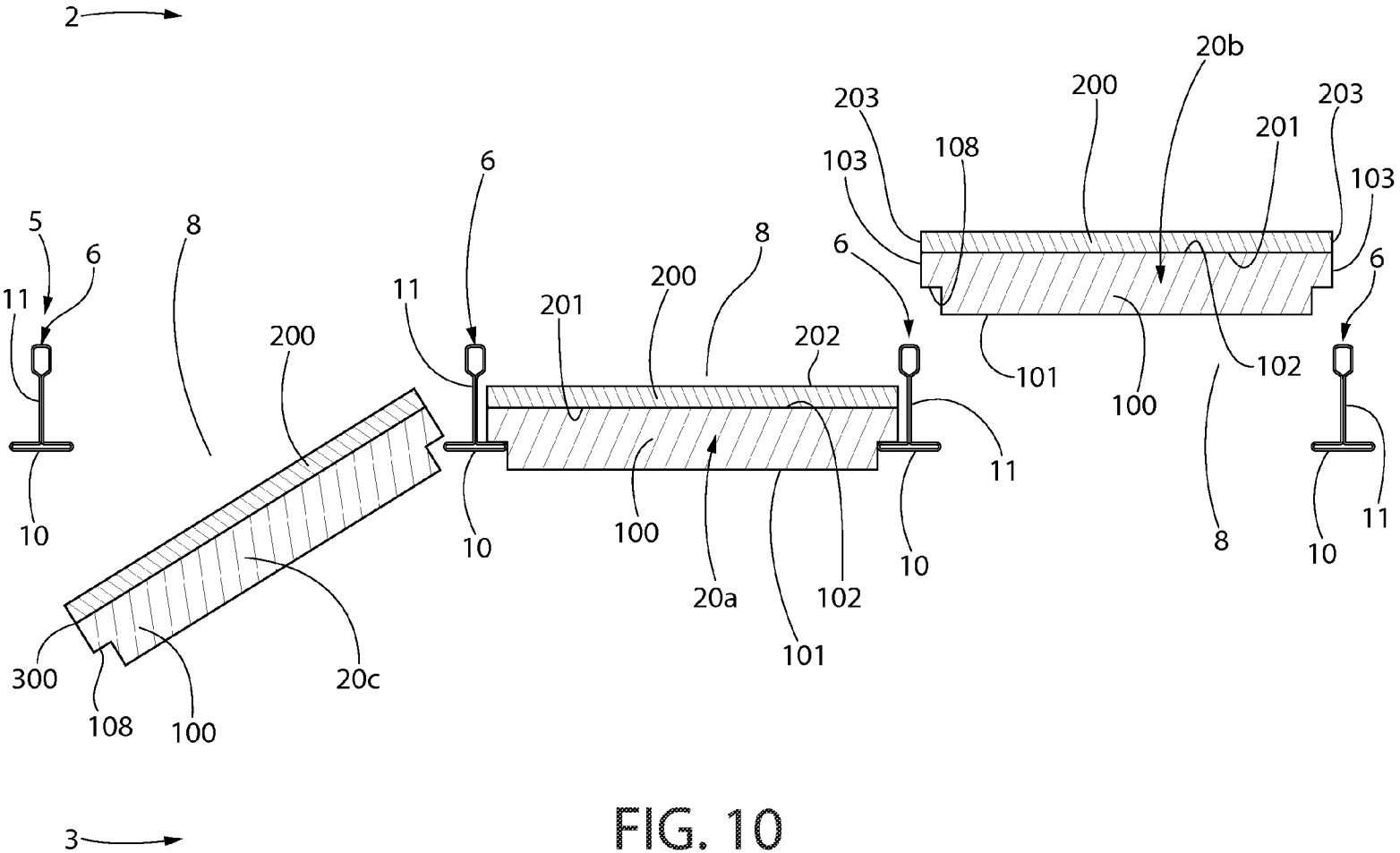
FIG. 10 is a side view of a partially installed ceiling system according to another embodiment of the present disclosure, including the support grid and a plurality of multi-component panels; and All drawings are schematic and not necessarily to scale. Parts given a reference numerical designation in one figure may be considered to be the same parts where they appear in other figures without a numerical designation for brevity unless specifically labeled with a different part number and described herein.

Subsequent to step c), step d) includes at least the first multi-component panel 20 being mounted to the support grid 5—as shown in FIG. 10. The first multi-component panel 20 may positioned within one of the plurality of openings 8 so that the upper major face 102 of the ceiling panel 100 is facing the plenary space 2. According to some embodiments, at least the first ceiling panels 100*a* is positioned within the opening 8 so that the ceiling panel 100 and the sound attenuation layer 200 are circumscribed by the sections 6A, 7A of intersecting first and second struts 6, 7.

In non-limiting embodiments, step d) may include mounting the multi-component panel 20*b* to the support grid 5 by dropping the multi-component panel 20*b* vertically downward from the plenary space 2 onto the support grid 5. The vertical drop of the multi-component panel 20*b* continues until at least one of the lower major surface 101 or the intermediate surface 108 of the ceiling panel 100 abuts the top surface of the flange 10. Using the drop down methodology, the multi-component panel 20*b* may stay substantially level with respect to the support grid 5 entirely during step d). The term "substantially" in this case means a change in relative orientation of +/−15°. During this step, the side surfaces 203 of the sound attenuation layer 200 do not pass the support flange 10 of the first and second struts 6, 7.

In other non-limiting embodiments, the multi-component panel 20*c* may be raised vertically up into the support grid 5 from the room environment 3. To raise the multi-component panel 20 onto the support grid 5, the multi-component panel 20*c* must be temporarily oriented at an oblique angle relative to the support grid 5 for the side surfaces 103, 203 of the ceiling panel 100 and the sound attenuation layer 200 to clear the horizontal flange 10 of the support grid 5. Once the side surfaces 103, 203 of the ceiling panel 100 and the sound attenuation layer 200 have cleared the horizontal flanges 10 of the support grid 5, the multi-component panel 20 can be reoriented to level position relative to the support grid 5. The multi-component panel 20 may then be lowered vertically until at least one of the lower major surface 101 or the intermediate surface 108 of the ceiling panel 100 abuts the top surface of the flange 10—as shown in FIG. 10.

As shown in FIG. 6, after the ceiling panel 100 has been mounted to the support grid 5, at least one of the intermediate surface 108 or the lower major surface of the ceiling panel 100 may abut at least a portion of a top surface of the horizontal flange 10 of at least one of the first member 6 or the second member 7 of the support grid 5. The abutment between the intermediate surface 108 of the ceiling panel layer 100 and the top surface of the horizontal flange 10 allows the ceiling panel 10 to rest in a fully installed position. Once fully mounted, both the ceiling panel 100 and the sound attenuation layer 200 are circumscribed by the sections 6A, 7A of intersecting first and second struts 6, 7.

The term free-floating as used in the present disclosure refers to an interface that is substantially free of adhesive or mechanical attachment. The term "substantially free of adhesive" means an amount of adhesive that is less than enough sufficient to impart structural integrity between the ceiling panel 100 and the sound attenuation layer 200. In some embodiments, after the first sound attenuation layer 200 is positioned in a free-floating relationship atop the upper major surface 102 of the ceiling panel 100, the only coupling between the lower major surface 201 of the first sound attenuation layer 200 and the upper major surface 102 of the ceiling panel 100 is contact between the lower major surface 201 of the first sound attenuation layer 200 and the upper major surface of the first ceiling panel 100 resulting from gravitational pull on the first sound attenuation layer 200.

According to some embodiments, at least one of the multi-component panels 20 may positioned within a grid opening 8 so that the ceiling panel 100 and the sound attenuation layer 200 are circumscribed by the sections 6A, 7A, of the intersecting first and second struts 6, 7. As shown in FIG. 5, after the sound attenuation layer 200 is positioned atop the ceiling panel 100, a surface contact interface 300 is between the lower major surface 201 of the sound attenuation layer 200 and the upper major surface 102 of the ceiling panel 100. The surface contact interface 300 may be substantially free of adhesive.

According to some embodiments, as shown in FIG. 8, the web portion 11 of each of the sections of the intersecting struts—i.e. the sections of the plurality of first struts 6 and the sections of the plurality of second struts 7 (not pictured)—extend above the surface contact interface 300 of the multi-component panel 20. According to some embodiments, the web portion 11 of each of the sections of the intersecting struts—i.e. the sections of the plurality of first struts 6 and the sections of the plurality of second struts 7—are lower than the surface contact interface 300 (not pictured).

In non-limiting embodiments, the multi-component panel 20 may be a circle, oval, or polygon—e.g., rectangular (including square and non-square shapes) or triangular. According to these embodiments the ceiling panel 100 and the sound attenuation layer 200 share the shape of the overall multi-component panel 20. In some embodiments, the polygonal ceiling panels 20 may have rounded or sharp corners.

According to some embodiments, the multi-component panel 20 is substantially rectangular—the term "substantially rectangular" means a shape having four edges and four corners. Each corner forms angle ranging from 88 to 92 degrees—alternatively about a 90 degrees. The four side surfaces 103 are either the same length (square) or have a first pair of edges that are parallel to each other and extend a first length and a second pair of edges that are parallel to each other and extend a second length, wherein the first and second lengths are not equal (non-square).

In some embodiments, the multi-component panel 20 is rectangular, wherein the first pair of edges and second pair of edges each have a length of 2 feet. In some embodiments, the multi-component panel 20 has an overall thickness ranging from about 1.25 inches to about 2 inches—alternatively about 1.75 inches.

The multi-component panel 20 of the present invention exhibits certain acoustical performance properties. Specifically, the American Society for Testing and Materials (ASTM) has developed test method E1414 to standardize the measurement of airborne sound attenuation between room environments 3 sharing a common plenary space 2. The rating derived from this measurement standard is known as the Ceiling Attenuation Class (CAC). Ceiling materials and systems having higher CAC values have a greater ability to reduce sound transmission through the plenary space 2—i.e. sound attenuation function.

Another important characteristic for the acoustic ceiling panel materials is the ability to reduce the amount of reflected sound in a room. One measurement of this ability is the Noise Reduction Coefficient (NRC) rating as described in ASTM test method C423. This rating is the average of sound absorption coefficients at four ⅓ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection—sound absorption function.

Previous attempts to design acoustic ceiling panel shaving increased CAC values (i.e., desirable reduction of sound transmission through the plenary space 2), has been tied with a simultaneous decrease in sound absorption (NRC), which causes an increased amount of sound reflected within a given room environment 3. It has been discovered that by using the multi-component panel 20 of the present disclosure, an increase in CAC performance can be achieved without loss in NRC performance.

Specifically, by positioning the sound attenuation layer 200 in a free-floating relationship atop the upper major surface 102 of the ceiling panel 100, it has been discovered that the resulting multi-component panel 20 will demonstrate a marked improvement in CAC performance while avoiding degradation in NRC performance.

Specifically, the multi-component panel 20, of the present disclosure has a CAC value of at least 37 and an NRC value of at least 0.95. The ceiling panel 100 may exhibit an NRC value of 0.90 prior to the sound attenuation layer being positioned atop the ceiling panel 100. The sound attenuation layer may have a CAC value of at least 35 and an NRC value of at least 0.65 prior to being positioned atop the ceiling panel 100.

In some embodiments, the multi-component panel 20 of the present disclosure is formed by using a sound attenuation layer 200 that has a CAC value that is greater than a CAC value of the ceiling panel 100. The sound attenuation layer 200 may also have an NRC value that is less than the NRC value of the ceiling panel 200. The ceiling panel layer 100 may be a noise absorption layer that provides sound dampening within a single room environment 3. The sound attenuation layer 200 may be a noise blocking layer that provides soundproofing between adjacent room environments 3 that share the same plenary space 2.

The invention will be described in greater detail by way of specific examples. The following examples are offered for illustrative purposes and are not intended to limit the invention in any manner.

EXAMPLES

The examples were prepared using a 24 inch×24 inch×1 inch ceiling panel comprised of fiberglass and a 24 inch×24 inch×0.75 inch sound attenuation layer comprised of mineral wool. The ceiling panel and sound attenuation layers have the following acoustical properties:

| Fiberglass Ceiling Panel | | Mineral Wool Sound Attenuation Layer | |
|---|---|---|---|
| NRC Value | 0.95 | NRC Value | 0.70 |
| CAC Value | N/A | CAC Value | 40 |

For the purpose of this disclosure, each of the individual fiberglass ceiling panels has the same starting acoustical performance. For the purpose of this disclosure, each of the individual mineral wool sound attenuation layers has the same starting acoustical performance.

Regarding Examples 1 and 2, each of the sound attenuation layers were laid on the upper major surface of the ceiling panel in a free-floating relationship without any adhesive present in the contact interface.

Regarding Comparative Example 1, the upper major surface of the ceiling panel and the sound attenuation layer were adhered together using polyvinyl acetate adhesive. Twenty grams of the adhesive was applied as eight parallel lines that extend diagonally across the upper major surface of the ceiling panel.

Regarding Comparative Examples 2 and 3, the upper major surface of the ceiling panel and the sound attenuation layer were adhered together using polyvinyl acetate adhesive. Twenty grams of the adhesive was applied as sixteen checker board lines extend across the upper major surface of the ceiling panel.

For the purposes of this invention, the starting acoustical performance of the Lyra 8361 panel and the Optima 3251 panel are essentially equal.

TABLE 1

| | Gauge (inches) | Interface (Amount of Adhesive) | NRC | CAC |
|---|---|---|---|---|
| Example 1 | 1.76 | Free-Floating (0 g) | 1.0 | 44 |
| Example 2 | 1.75 | Free-Floating (0 g) | 1.0 | 43 |
| Comparative Example 1 | 1.76 | 8 parallel lines (20 g) | 1.00 | 40 |
| Comparative Example 2 | 1.77 | 16 check pattern lines (40 g) | 1.0 | 40 |
| Comparative Example 3 | 1.78 | 16 check pattern lines (40 g) | 1.0 | 39 |

As demonstrated by Table 1, positioning the sound attenuation layer in a free-floating relationship atop the upper major surface of the ceiling panel results in a marked improvement in CAC performance without and degradation in NRC value performance.

Furthermore, positioning the sound attenuation layer in a free-floating relationship atop the upper major surface of the ceiling panel according to the present invention surprisingly resulted in improved CAC performance with an overall decrease in ceiling panel thickness. CAC performance is a measure of soundproofing between adjacent room environments—it is expected that as thickness of the barrier between adjacent room environments decreases, so does CAC performance. Thus, positioning the sound attenuation layer in a free-floating relationship atop the upper major surface of the ceiling panel according to the present invention allows for improved CAC performance while decreasing the volume required for such ceiling panel.

As those skilled in the art will appreciate, numerous changes and modifications may be made to the embodiments described herein, without departing from the spirit of the invention. It is intended that all such variations fall within the scope of the invention.

The invention claimed is:

1. A method of installing a ceiling system comprising:

a) mounting a first ceiling panel to a support grid, the first ceiling panel formed of a sound absorbing material and having an upper major surface opposite a lower major surface, the upper major surface of the first ceiling panel facing a plenary space that is formed above the support grid, wherein the first ceiling panel has an NRC value of at least 0.9; and b) subsequently positioning a first sound attenuation layer in a free-floating relationship atop the upper major surface of the first ceiling panel, wherein the first sound attenuation layer has a CAC value of at least 37, thereby forming a first multi-component panel having a CAC value of at least 40 and an NRC value of at least 0.95.

2. The method according to claim 1, wherein the upper major surface of the first ceiling panel has a length and a width and the first sound attenuation layer has a length and a width, wherein the length of the upper major surface of the first ceiling panel is substantially equal to the length of the first sound attenuation layer and the width of the upper major surface of the first ceiling panel is substantially equal to the width of the first sound attenuation layer.

3. The method according to claim 1, wherein the upper major surface of the first ceiling panel has a length and a width and the sound attenuation layer has a length and a width, wherein at least one of the length of the upper major surface of the first ceiling panel is greater than the length of the sound attenuation layer or the width of the upper major surface of the first ceiling panel is greater than the width of the sound attenuation layer.

4. The method according to claim 1, further comprising: prior to step b):

providing a sound attenuation sheet having a length greater than a length of the first ceiling panel;

cutting the first sound attenuation layer from the sound attenuation sheet, wherein the first sound attenuation layer has a length that is substantially equal to the length of the ceiling panel.

5. The method according to claim 1, wherein the first sound attenuation layer has a CAC value of at least 40 and an NRC value of at least 0.65, prior to being positioned atop the first ceiling panel.

6. The method according to claim 1, wherein the first sound attenuation layer has a lower major surface, and wherein upon completion of step b), the only coupling between the lower surface of the first sound attenuation layer and the upper major surface of the first ceiling panel is surface contact between the lower surface of the first sound attenuation layer and the upper major surface of the first ceiling panel resulting from gravitation pull on the first sound attenuation layer.

7. The method according to claim 1, wherein the support grid comprises a plurality of intersecting struts forming a plurality of openings and wherein the first one of the openings is defined by sections of opposing first ones of the intersecting struts and sections of opposing second ones of the intersecting struts; and wherein each of the first ceiling panel and the first sound attenuation layer are circumscribed by the sections of the first and second ones of the struts.

8. The method according to claim 7, wherein upon completion of step b), a surface contact interface is formed between a lower surface of the first sound attenuation layer and the upper major surface of the first ceiling panel; wherein each of the sections of the first and second ones of the struts comprises a web portion; and wherein upon completion of step b), the web portions of each of the sections of the first and second ones of the struts extend above the surface contact interface.

9. The method according to claim 7, wherein upon completion of step b), a surface contact interface is formed between a lower surface of the first sound attenuation layer and the upper surface of the first ceiling panel; wherein each of the sections of the first and second ones of the struts comprises a web portion; and wherein upon completion of step b), the web portions of each of the sections of the first and second ones of the struts are lower than the surface contact interface.

10. The method according to claim 1, further comprising: prior to step b), mounting a second ceiling panel to the support grid within a second one of the openings, the second one of the openings being adjacent the first one of the openings, the second ceiling panel formed of the sound absorbing material and having an upper major surface and a lower major surface that is opposite the upper major surface of the second ceiling panel, the upper major surface of the second ceiling panel facing the plenary space; and wherein step b) further comprises positioning the first sound attenuation layer in a free-floating relationship atop the upper major surface of the second ceiling panel, thereby forming a second multi-component panel having a CAC value greater than 37.

11. A method of installing a ceiling system comprising:

a) providing a first ceiling panel having an upper major surface opposite a lower major surface, wherein the first ceiling panel has an NRC value of at least 0.9;

b) subsequent to step b), overlaying a first sound attenuation layer in a free-floating relationship on the upper major surface of the first ceiling panel, wherein the first sound attenuation layer has a CAC value of at least 37, thereby forming a multi-component panel having a CAC value of at least 40 and an NRC value of at least 0.95; and c) subsequent to step b), mounting the multi-component panel to a support grid within an internal space of a building such that the upper major surface of the first ceiling panel is facing a plenary space that is formed above the support grid.

12. The method according to claim 11, wherein the upper major surface of the first ceiling panel has a length and a width and the first sound attenuation layer has a length and a width, wherein the length of the upper major surface of the first ceiling panel is substantially equal to the length of the first sound attenuation layer and the width of the upper major surface of the first ceiling panel is substantially equal to the width of the first sound attenuation layer.

13. The method according to claim 11, wherein the upper major surface of the first ceiling panel has a length and a width and the first sound attenuation layer has a length and a width, wherein at least one of the length of the upper major surface of the first ceiling panel is greater than the length of the first sound attenuation layer or the width of the upper major surface of the first ceiling panel is greater than the width of the first sound attenuation layer.

14. The method according to claim 11, wherein the first sound attenuation layer has a CAC value of at least 40 and an NRC value of at least 0.65, prior to being positioned atop the first ceiling panel.

15. The method according to claim 11, wherein the first ceiling panel has an NRC value of at least 0.95, prior to the first sound attenuation layer being positioned atop the first ceiling panel.

16. The method according to claim 11, wherein the first sound attenuation layer has a lower surface, and wherein upon completion of step b), the only coupling between the lower surface of the first sound attenuation layer and the upper major surface of the first ceiling panel is surface contact between the lower surface of the first sound attenuation layer and the upper major surface of the first ceiling panel resulting from gravitation pull on the first sound attenuation layer.

17. The method according to claim 11, wherein the support grid comprises a plurality of intersecting struts forming a plurality of openings and wherein the first one of the openings is defined by sections of opposing first ones of the intersecting struts and sections of opposing second ones of the intersecting struts; and wherein subsequent to step c) each of the first ceiling panel and the first sound attenuation layer are circumscribed by the sections of the first and second ones of the struts.

18. The method according to claim 11, wherein the support grid comprises a plurality of intersecting struts forming a plurality of openings and wherein upon completion of step b), a surface contact interface is formed between a lower surface of the first sound attenuation layer and the upper major surface of the first ceiling panel; wherein each of the sections of the first and second ones of the struts comprises a web portion; and wherein subsequent to step c), the web portions of each of the sections of the first and second ones of the struts extend above the surface contact interface.

19. The method according to claim 11, wherein upon completion of step b), a surface contact interface is formed between a lower surface of the first sound attenuation layer and the upper major surface of the first ceiling panel; wherein each of the sections of the first and second ones of the struts comprises a web portion; and wherein upon completion of step d), the web portions of each of the sections of the first and second ones of the struts are lower than the surface contact interface.

20. A ceiling system comprising:

a support grid within an internal space of a building so that a plenary space is formed above the support grid and an active room environment is formed below the support grid, the support grid comprising a plurality of intersecting struts forming a plurality of openings;

a first ceiling panel mounted to the support grid within a first one of the openings, the first ceiling panel formed of a sound absorbing material and having an upper major surface and a lower major surface that is opposite the upper major surface of the first ceiling panel, the upper major surface of the first ceiling panel facing the plenary space, wherein the first ceiling panel has an NRC value of at least 0.9; and a first sound attenuation layer positioned in a free-floating relationship atop the upper major surface of the first ceiling panel, wherein the first sound attenuation layer has a CAC value of at least 37, thereby forming a first multi-component panel having a CAC value of at least 40 and an NRC value of at least 0.95.

* * * * *